US006253378B1

(12) United States Patent
Nealy

(10) Patent No.: US 6,253,378 B1
(45) Date of Patent: Jul. 3, 2001

(54) HEADWEAR FOR TEAM WATER SPORTS

(76) Inventor: Robert Nealy, 4022 Calle Louisa, San Clemente, CA (US) 92672

( * ) Notice: Subject to any disclaimer, the term of this patent is extended or adjusted under 35 U.S.C. 154(b) by 0 days.

(21) Appl. No.: 09/515,934

(22) Filed: Feb. 29, 2000

(51) Int. Cl.[7] ..... A02B 1/12
(52) U.S. Cl. ..... 2/68
(58) Field of Search ..... 2/60, 67, DIG. 2

(56) References Cited

U.S. PATENT DOCUMENTS

| | | | | |
|---|---|---|---|---|
| 1,441,180 | * | 1/1923 | Shaw | 2/DIG. 2 |
| 1,538,847 | * | 5/1925 | Wheeler | 2/DIG. 2 |
| 2,009,866 | * | 7/1935 | Young | 2/68 |
| 2,520,049 | * | 8/1950 | Moore | 2/68 |
| 2,533,444 | * | 12/1950 | Feldman | 2/68 |
| 3,454,962 | * | 7/1969 | Hind | 2/68 |
| 3,979,777 | * | 9/1976 | Gregg | 2/68 |
| 6,088,840 | * | 7/2000 | Im | 2/411 |

* cited by examiner

*Primary Examiner*—Bibhu Mohanty

(57) ABSTRACT

A cap for wearing under the team designating outer cap during team water sports consists of a hemispherically shaped body defining side sections and the first and a second transverse section. The cap is reversible so that either the first or the second transverse section can be worn over the forehead of the wearer. To prevent a violation of rules and to avoid confusing the players it is conventional that the inner cap resemble the outer cap in color. Conventionally one team wears a white or light-colored cap while the opposing team wears a dark colored cap. The inner cat of the present invention is provided with dark indicia covering the portion of the surface of one of the transverse sections so that in the event the outer cap rides back on the players head exposing the portion of the inner cap, the indicia will substantially reduce possible confusion which could occur if the players catch a glimpse of the normally light-colored inner cap. Being reversible, the light-colored transverse section can be worn over the players forehead when wearing the light-colored outer cap.

3 Claims, 2 Drawing Sheets

HEADWEAR FOR TEAM WATER SPORTS

FIELD OF THE INVENTION

This invention relates to swimmers head wear and more particularly to swimmers head wear for team water sports.

BACKGROUND OF THE INVENTION

In team water sports is, such as water polo, it is conventional for members of each team to wear distinctive outer head wear so as to distinguish members of one team from those of the opposing team. Normally such head wear for one team is usually white or a light color and for the opposing team, a dark color. The outer head wear is a single size and it fits relatively loosely on the players head. Accordingly, it is conventional, particularly for female players, to wear a hair retaining cap under the outer cap.

In the course of engaging in the water sport, the outer cap will often move on the players head exposing a portion of the under cap. If the under cap is not similar in color to the outer cap it may appear that the player is a member of the opposing team whose outer cap resembles the players hair retaining under cap and which may result in possible confusion. For this reason water sports such as water polo have rules that require that the under cap resemble the outer cap in appearance. That is, if the outer cap is white or light-colored the under cap must also be white or light colored. Likewise, if the outer cap is dark the under cap must also be of the dark color. It is conventional for players to purchase and carry with them two under caps, a light and a dark cap, to accommodate the particular color of the outer cap.

SUMMARY OF THE INVENTION

There is described herein a reversible cap designed to be worn under an outer cap when engaged in team water sports. The cap is provided with both of a dark and a light surface so that either the light or dark surface can be worn over the forehead of the player depending upon the color of the outer cap. As the outer cap moves during play, the exposed surface of the under cap resembles the color of the outer cap and thus conforms with the rules of the sport and avoids any possible confusion that may occur should the other players see the under cap and confuse it with the outer cap of an opposing team member.

More particularly, the cap of the present invention is generally hemispherically shaped for a snug, hair retaining fit on the players head. A chin strap may be provided but it is not essential. When worn, the cap defines side sections which may extend to and cover a portion of the players ears and a first and second transverse section extending between the side sections to complete the hemispherically shaped cap. One of the transverse sections will be worn over the forehead of the player while the other transverse section will cover the back of the players head. The cap can be worn with either the first or the second transverse section covering the forehead of the player thus making the cap reversible. The cap is normally formed of a rubber like material, such as a latex, and it may be molded as a single piece or formed in two pieces joined at a middle seam.

In accordance with the invention at least a portion of the surface of each of the transverse sections is provided with indicia resembling the color of the outer cap. That is, one of the transverse sections will be provided with a dark color indicia to resemble the dark color outer cap while the opposite transverse section is provided with light-colored indicia to resemble a light-colored outer cap. The color of the outer cap determines which transverse section is worn to the front of the player.

DESCRIPTION OF THE PREFERRED EMBODIMENT

Figure 1:
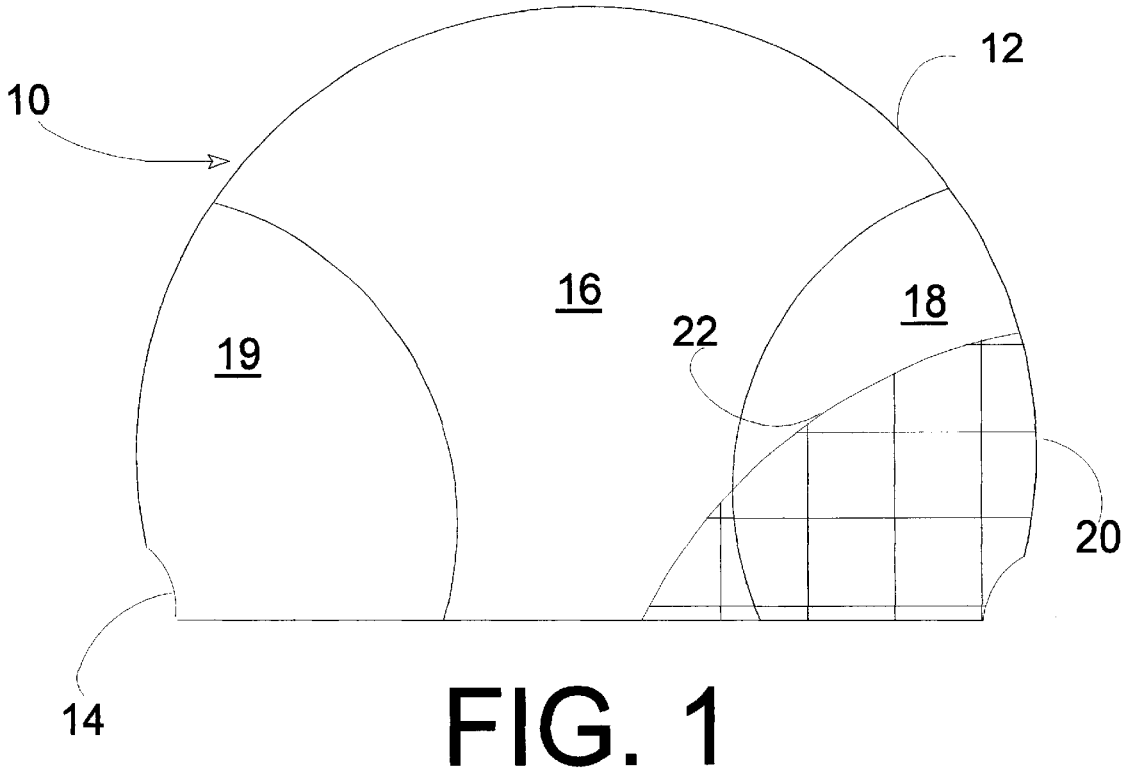
FIG. 1 is a side view of an under cap designed in accordance with a present invention.

Referring initially to FIG. 1, a cap, shown generally as 10, is illustrated that is designed to retain the hair of the wearer and to fit snugly on the wearer's head under an outer cap (not shown) that is colored or contains a logo to designate the wearer's team. The under cap 10, comprises a generally hemispherically shaped portion 12 that terminates in a generally annular portion 14. The annular portion 14 has slightly less circumference than the hemispherically shaped portion 12 at its greatest circumference. The cap I 10 is formed of a resilient elastic material such as a rubber latex. The annular portion 14 is stretched to fit over the wearer's head and, due to its elastic properties, serves as an elastic belt to secure the cap 10 on the wearer's head. The cap may be formed as a single piece or formed as two halves which are joined to define a medial seam. As worn, the cap 10 defines two side sections 16 and two transverse sections 18 and 19. The cap 10 is reversible and can be worn with either transverse section 18 or 19 to the front over the wearer's forehead.

Figure 2:
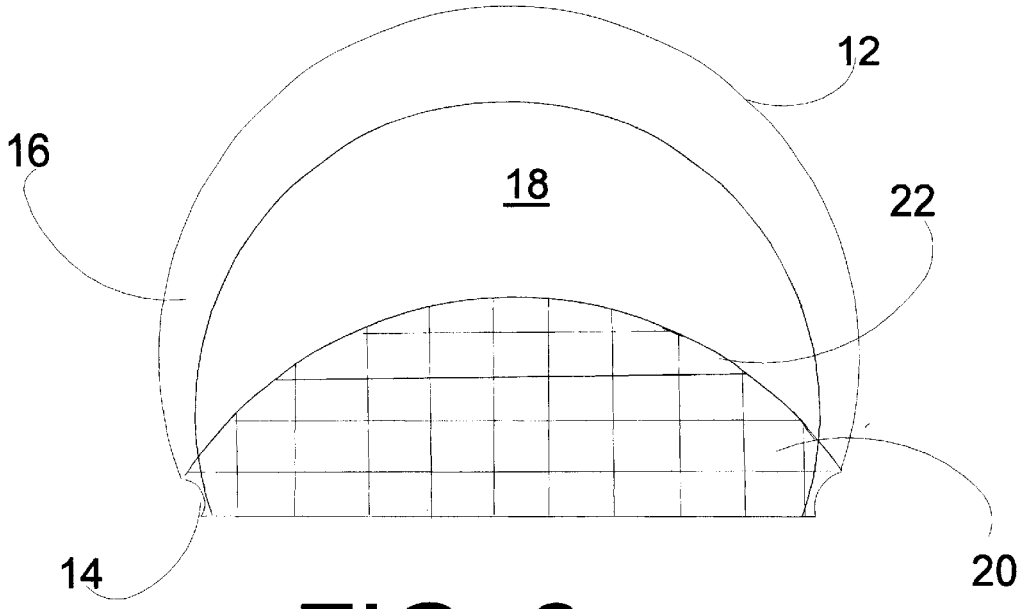
FIG. 2 is a front view of FIG. 1.

Referring again to FIG. 1 and further to FIG. 2, a portion of the surface of the transverse section 18 is provided with indicia 20. The indicia 20 is colored to resemble the color of the outer cap and additionally it may contain a logo, such as a national flag or team logo. As illustrated, the indicia 20 extends around the annular portion 14 of the transverse section 18 starting from approximately the midpoint of a side section 16 and terminating approximately at the midpoint of the opposite side section. The upper edge 22 of the indicia 20 is elliptically shaped and extends upwardly from the start and terminal points on the annular portion 14 over a portion of the surface of the transverse section 18. The angle described by the elliptical upper edge 20 should be sufficiently large to provide a significant amount of surface coverage by the indicia. Preferably, this angle is at least 30° and more preferably about 45°.

In use the cap 10 is worn toward the back of the wearer's head with one of the transverse sections 18 or 19 extending over the forehead of the wearer. In FIGS. 1 and 2, the transverse section 18 is the forward section and is provided with dark indicia 20. In this configuration the is cap 10 is to be worn under a dark outer cap with the transverse section 18 over the wearer's forehead. During play the outer cap -may move rearwardly on the wearer's head exposing the dark indicia 20 on the transverse section 18 of the under cap 10. Since the indicia 20 resembles the dark outer cap in appearance there is no danger of causing the other players to think that the player wearing the cap 10 is a member of the opposing team that is wearing the light colored outer caps. Subsequently when the wearer's team is wearing the light colored outer caps, the under cap 10 can be reversed so that the transverse section 19, being of lighter color, extends over the wearer's forehead.

Figure 3:
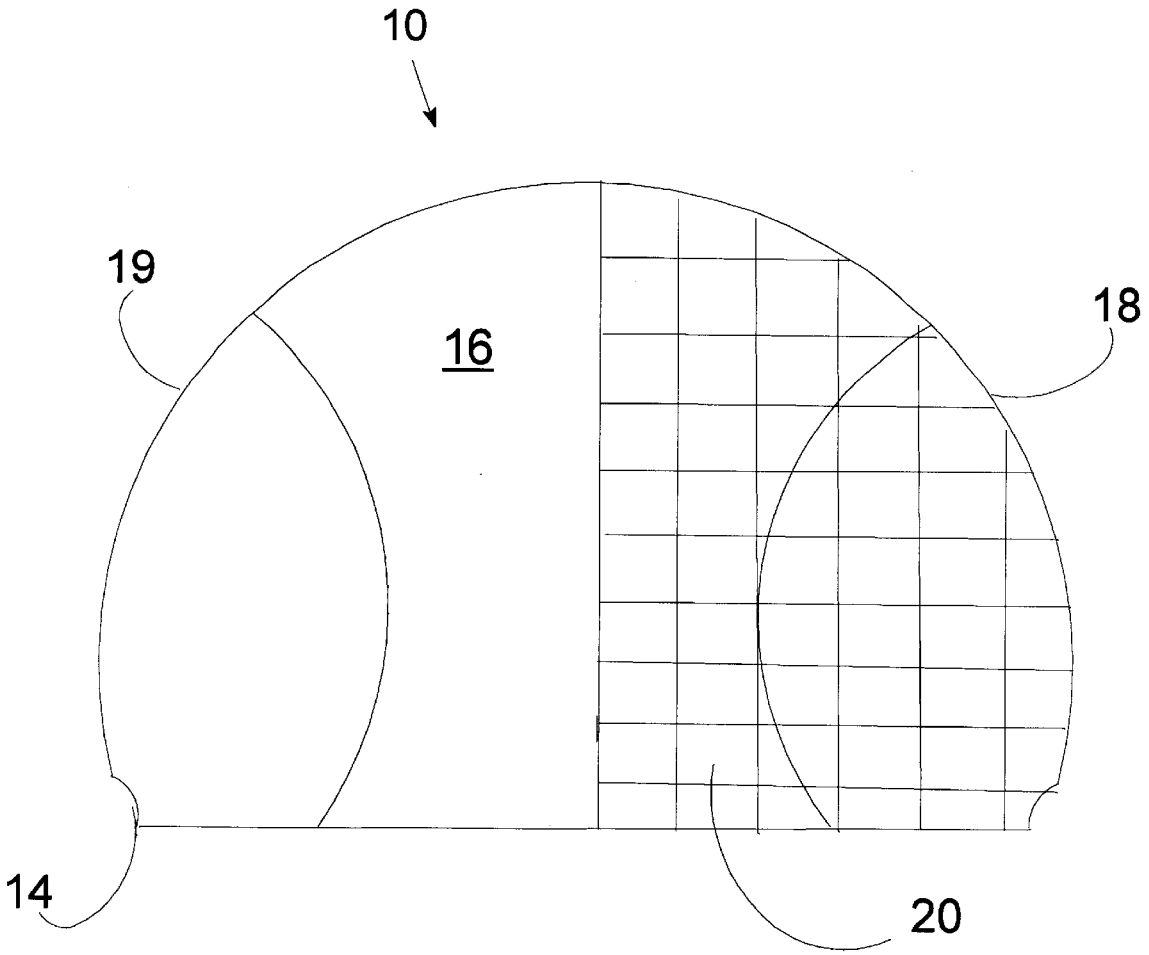
FIG. 3 is a side view of a cap designed in accordance with another embodiment of the present invention.

While the indicia 20 has been illustrated as covering only portion of either of the transverse sections 18, it will be understood that the cap 10 may more conveniently be manufactured if the indicia 20 covers a larger surface of cap, such as, for example, the entire surface of either transverse section 18 or 19. Thus, as illustrated in FIG. 3, wherein like reference numbers denote like parts, the cap 10 is shown with the indicia covering the surface of approximately half of the side sections 16 and entire surface of the transverse section 18. The cap is reversible as described above in connection with FIGS. 1 and 2.

While the cap 10 of the present invention has been described thus far as having both dark colored and light colored areas on a single surface, it will be understood that the advantages of the invention are achieved by providing an entire surface of the cap with dark colored indicia. In this embodiment, the cap 10 is simply turned inside out to present the proper outer surface. Thus, the generally hemispherically shaped body 14 is adapted to fit snugly over a player's head as described above, The body 14 defines first and second surfaces that are reversible so that either the first or the second surface defines the outer surface of the cap 10, One of the body surfaces has dark colored indicia and the opposite surface is light colored. The cap 10 is turned inside out to change the outer surface of the under cap from dark to light or from light to dark.

From the foregoing it can be seen that an under cap is provided that can be worn under either a light colored or a dark colored outer cap. The necessity of purchasing and carrying two under caps is eliminated. While the embodiments of the invention described herein have the dark colored indicia 20 on the transverse section 18 it will be understood the dark colored indicia can just as well be placed on the transverse section 19 rather than transverse section 18.

As will be understood by those skilled in the art, various arrangements which lie within the spirit and scope of the invention other than those described in detail in the specification will occur to those persons skilled in the art. It is therefor to be understood that the invention is to be limited only by the claims appended hereto.

What is claimed is:

1. In team water sports where members of one team wear outer caps of a dark color and members of an opposing team wear outer caps of a light color to distinguish players of one team from members of the opposing team, an under cap to be worn beneath said outer cap, said under cap being generally hemispherically shaped and adapted to fit snugly over the players head, said under cap defining side sections and a first and a second transverse section, the improvement comprising:

at least a portion of the surface of one of said transverse sections being provided with dark colored indicia to resemble the dark color of said outer cap and at least a portion of the surface of said other transverse section being light-colored to resemble the light-colored outer cap, said dark color indicia beginning at the midpoint of said side sections and extending horizontally around one of said transverse sections to terminate at the midpoint of said opposite side section and extending upwardly from the beginning and end points at an angle of at least 30° to define an elliptical upper edge around said transverse section.

2. The under cap of claim 1 wherein said dark color indicia extends upwardly from the beginning and end points at an angle of about 45°.

3. The under cap of claim 1 wherein said dark indicia extends over half of said hemispherically shaped body including all of one of said transverse sections, said cap being reversible so that either of said transverse sections can be worn over the forehead of a wearer.

* * * * *